US010132212B2

(12) United States Patent
Hentsch et al.

(10) Patent No.: US 10,132,212 B2
(45) Date of Patent: Nov. 20, 2018

(54) CAM PHASER

(71) Applicant: Hilite Germany GmbH, Marktheidenfeld (DE)

(72) Inventors: Florian Hentsch, Gruibingen (DE); Patrick Gautier, Freiburg (DE)

(73) Assignee: Hilite Germany GmbH, Marktheidenfeld (DE)

( * ) Notice: Subject to any disclaimer, the term of this patent is extended or adjusted under 35 U.S.C. 154(b) by 55 days.

(21) Appl. No.: 15/263,667

(22) Filed: Sep. 13, 2016

(65) Prior Publication Data

US 2017/0067377 A1 Mar. 9, 2017

Related U.S. Application Data

(63) Continuation of application No. PCT/EP2015/063454, filed on Jun. 16, 2015.

(30) Foreign Application Priority Data

Jun. 19, 2014 (DE) ..... 10 2014 009 091

(51) Int. Cl.
*F01L 1/34* (2006.01)
*F01L 1/344* (2006.01)

(52) U.S. Cl.
CPC ... *F01L 1/3442* (2013.01); *F01L 2001/34456* (2013.01); *F01L 2001/34469* (2013.01)

(58) Field of Classification Search
CPC ..... F01L 1/3442; F01L 2001/34456; F01L 2001/34469
USPC ..... 123/90.15, 90.17
See application file for complete search history.

(56) References Cited

U.S. PATENT DOCUMENTS 7,290,510 B2 * 11/2007 Takahashi ..... F01L 1/022 123/90.17

FOREIGN PATENT DOCUMENTS

| | | |
|---|---|---|
| DE | 102004022097 | 12/2005 |
| DE | 102007004184 A1 | 7/2008 |
| DE | 102007019920 A1 | 11/2008 |
| DE | 102010060263 A1 | 5/2012 |
| DE | 102013003556 A1 | 9/2013 |
| JP | 2013019356 | 1/2013 |

* cited by examiner

*Primary Examiner* — Ching Chang
(74) *Attorney, Agent, or Firm* — Von Rohrscheidt Patents

(57) ABSTRACT

A cam phaser including a rotor; and a stator, wherein the rotor is rotatable relative to the stator, wherein a lobe of the rotor is arrangeable between two bars of the stator, wherein the lobe divides an intermediary space formed between the two bars into a first pressure cavity and a second pressure cavity, wherein a locking device including a spring loaded locking bolt and a locking disc is configured to lock the stator relative to the rotor in an end position, wherein the locking provides a locking clearance for moving the rotor relative to the stator, wherein the locking disc includes a contact element for adjusting the end position.

12 Claims, 4 Drawing Sheets

CAM PHASER

RELATED APPLICATIONS

This application is a continuation of International application PCT EP 2015 063 454 filed on Jun. 16, 2015 which claims priority from German patent application DE 10 2014 009 091.4 filed on Dec. 24, 2015, both of which are incorporated in their entirety by this reference.

FIELD OF THE INVENTION

The invention relates to a cam phaser according to the preamble of claim 1.

BACKGROUND OF THE INVENTION

Cam phasers for internal combustion engines are well known. In a typical cam phaser a locking bolt that is adjustable in a controlled manner is arranged in a sliding manner in a bore hole in a rotor lobe of the cam phaser so that it facilitates locking a rotation of the rotor relative to a stator under certain operating conditions of the cam phaser and the motor. A known bolt locking mechanism includes a compression spring which clamps an end of the bolt in a typically hardened seat which is arranged in a pulley or in a chain sprocket of the cam phaser so that the rotor is interlocked with reference to the stator that is fixated at the pulley or the chain sprocket.

The rotor can be made for example from aluminum and a steel bushing is pressed into the bore hole at a particular axial position and inserted so that the bolt is supported.

A cam phaser is disclosed in the publication document DE 10 2010 060 263 A1 wherein the cam phaser includes a substantially hollow cylindrical bolt which receives a compression spring in a hollow cylindrical section. During assembly of the cam phaser a so called active adjustment is performed, wherein the stator or the stator housing is rotated relative to a locking disc that is engageable by the bolt so that a corresponding locking clearance is adjusted. The stator is then positioned by typically 4 to 5 bolts relative to the locking disc. For positioning the rotor during assembly the stator is provided as a stop for the rotor.

As a matter of principle a certain locking clearance has to be maintained between a bar of the stator and a wing of the rotor in a locking position. This locking clearance is necessary so that a binding of the locking bolt and the locking disc is excluded during locking and unlocking and the noise emission can be minimized.

However, there is a problem in that the locking clearance can be faulty due to a tolerance concatenation that is created during assembly of the cam phaser so that a binding of the locking bolt and the locking disc can occur during operation of the cam phaser.

BRIEF SUMMARY OF THE INVENTION

Thus, it is an object of the present invention to provide a cam phaser with improved operational reliability.

The object is achieved by a cam phaser with features of patent claim 1. Advantageous embodiments with useful and non-trivial variations of the invention are provided in the respective dependent claims.

The cam phaser according to the invention includes a rotor and a stator, wherein the rotor is rotatable relative to the stator about a rotation axis of the cam phaser. Between two bars of the stator a lobe of the rotor is arrangeable wherein an intermediary space configured between the two bars can be divided into a first pressure chamber and a second pressure chamber by the lobe. A locking device is provided for locking the stator and the rotor wherein the locking device includes a spring loaded locking bolt and a locking disc for locking the stator relative to the rotor in an end position. During locking a locking clearance is provided so that the rotor is movable relative to the stator by a small amount that is in a range of a locking clearance. In order to adjust the end position the locking disc includes a contact element.

The locking clearance determines functionally reliable operations of the cam phaser so that the camshaft is adjustable relative to the crankshaft in a quick and effective manner. This adjustment is used for obtaining optimum operating points for the internal combustion engine. When optimum operating points are adjusted the internal combustion engine can achieve a high power output for a low fuel burn so that prescribed emission standards can be maintained.

Taking tolerances of particular components of the cam phaser into account is essential for maintaining an exact locking clearance or put differently taking the clearance of locking relevant components into account during assembly. This means in addition to the desired locking clearance the respective tolerances of the locking clearing relevant components are added up and form a tolerance concatenation. All fabrication induced diameter, length and angle tolerances add into the tolerance concatenation as well as geometric tolerances like position tolerances of the locking clearance relevant components. This means that the locking clearance is adjustable the more precisely and exactly the fewer component tolerances add into the tolerance concatenation.

The locking disc of the cam phaser according to the invention has a contact pin. Using the contact pin renders an active adjustment redundant and the stator is removed from the tolerance concatenation since all necessary tolerances are only in the locking disc.

During assembly of the cam phaser the rotor is coaxially positioned on the locking disc, wherein a lobe of the rotor is moved towards the contact pin until the lobe contacts the contact pin. The rotor and the locking disc are retained in this position by the locking device.

Advantageously the locking bolt is positioned at the lobe of the rotor, wherein the locking bolt is configured so that it is receivable in its entirety in a receiving opening of the lobe so that an unimpeded movement of the rotor relative to the stator is also provided for an unlocking due to complete reception of the locking bolt in the lobe.

According to another embodiment of the invention the locking disc includes a locking bore hole for at least partially receiving the locking bolt. Thus, for locking and relative positioning of the rotor and the locking disc the locking bolt has to be inserted into the locking bore hole so that the rotor is fixated relative to the locking disc.

Eventually the stator is positioned coaxial to the rotor and relative to the locking disc interlocked with the rotor and fixated at the locking disc by a connecting element, typically a bolt, put differently so that it is not movable relative to the locking disc during operations.

Since the cam phaser according to the invention includes the contact pin for positioning the rotor in an end position the stator is eliminated as a component that contributes to the locking clearance in the tolerance concatenation so that in particular tolerances with respect to diameter and angle and with respect to positioning of the stator can be omitted.

Thus, a much more precise locking clearance is adjustable during assembly which provides much improved operating properties and thus improved operational reliability.

In another embodiment the contact element is provided as a pin. This facilitates ease of fabrication of the contact element which is received at the locking disc in a form locking manner and/or bonded thereto.

The assembly of the cam phaser is facilitated by arranging the contact element in the portion of the locking bore hole in which the locking pin is receivable. Arranging the contact element for example in another lobe of the rotor could cause a displacement of the rotor from the stop at the contact pin when locking the rotor with the locking disc during insertion of the locking bolt into the locking bore hole. This displacement can be very small, however, in view of a concatenation of the respective tolerances and including an exemplary locking clearance of 0.4° even a very small displacement or rotation of the rotor relative to the locking disc can lead to a change of the locking clearance. Therefore the contact pin is advantageously positioned in the portion of the locking bore hole.

Since the locking pin is used as a stop for the rotor the contact element is advantageously made from a first material which is harder and/or more impact resistant than a second material from which the stator is made and/or which is harder and/or more impact resistant than a third material from which the blocking disc is made. This leads to a wear reduction of the contact pin and thus additionally to improved operating safety of the cam phaser according to the invention.

In another embodiment of the cam phaser according to the invention the locking disc includes an additional contact pin for adjusting two different locking clearances. The original contact pin which is positioned proximal to the locking borehole limits a rotation angle of the rotor in a first direction of rotation or counter clockwise. Put differently this original contact pin defines a first end position. The additional contact pin is positioned further remote from the locking bore hole. However, the additional contact pin represents a second end position with respect to a second e.g. clockwise rotation that is opposite to the first rotation. Furthermore the two contact pins are positioned so that they provide a rotation limitation with respect to a lobe, in particular the lobe which includes the locking bolt. It is an advantage of this embodiment that a rotation clearance is adjustable with respect to the corresponding direction of rotation which provides further improved operational safety since slightly different torques impact the camshaft as a function of the direction of rotation so that different pressures are provided in the hub bore holes.

In order to reduce a number of components and thus weight the connecting element is a bolt by which a drive sprocket of the camshaft is connected with the stator torque proof.

BRIEF DESCRIPTION OF THE DRAWINGS

Additional advantages, features and details of the invention can be derived from the subsequent description of advantageous embodiments and from the drawing figures. The features and feature combinations recited in the preceding description and the features subsequently recited in the figure description and/or shown in the drawings are not only useable in the respectively recited combination but also in other combinations or by themselves without departing from the scope and spirit of the invention. Identical or functionally equivalent elements are associated with identical reference numerals. For reasons of clarity elements may not be provided in all figures with their respective reference numerals without losing their association, wherein.

DETAILED DESCRIPTION OF THE INVENTION

Figure 1:
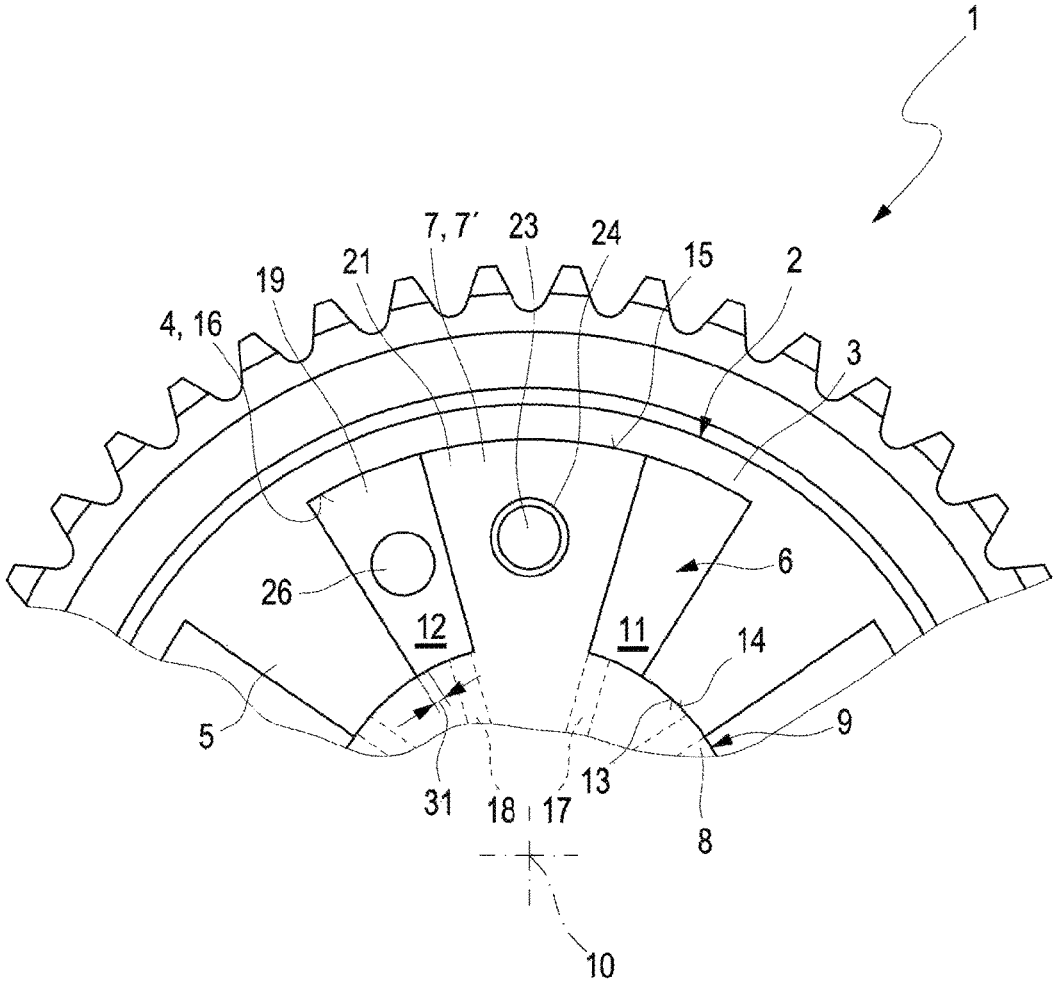
FIG. 1 PRIOR ART
FIG. 1 illustrates a schematic drawing of a prior art cam phaser.

A prior art cam phaser 1 illustrated in FIG. 1 facilitates adjusting opening and closing times of gas control valves of an internal combustion engine that is not illustrated in more detail during operations of the internal combustion engine.

For this purpose the cam phaser 1 continuously adjusts a relative angular position of a camshaft of the internal combustion engine that is not illustrated in more detail relative to the crankshaft of the internal combustion engine that is not illustrated in more detail in that the camshaft is rotated relative to the crankshaft. Rotating the camshaft moves the opening and closing times of the gas control valves so that the internal combustion engine delivers optimum power at a respective speed.

The cam phaser 1 includes a cylindrical stator 2 which is fixated torque proof at a drive wheel of the camshaft which is not illustrated in more detail.

The drive wheel can be configured as a chain sprocket over which a chain is run as a drive element that is not illustrated in more detail. By the same token the drive element can also be a cog belt pulley over which a drive belt is run as a drive element. The stator 2 is operatively connected with the crankshaft through this drive element and the drive wheel.

The stator 2 includes a cylindrical stator base element 3 which includes radially inward extending bars 5 that are arranged equidistant on an inside 4 of the stator base element 3, so that an intermediary space 6 is formed respectively between two adjacent bars 5. In this intermediary space 6 a pressure medium, in general a hydraulic fluid is introduced in a controlled manner by a hydraulic valve that is not illustrated in more detail.

A lobe 7 is arranged so that it protrudes into the interior space 6 wherein the lobe is arranged at a rotor hub 8 of a rotor 9. Corresponding to a number of intermediary spaces 6 the rotor hub 8 includes a number of lobes 7. The rotor 9 includes a rotation axis 10.

Thus, the lobe 7 divides the intermediary spaces 6 respectively into a first pressure cavity 11 and a second pressure cavity 12 in order to reduce a pressure loss in the first pressure cavity 11 and in the second pressure cavity 12, the bars 5 are configured so that they contact an outer enveloping surface 14 of the rotor hub 8 in a sealing manner with their first faces 13. The lobes 7 also contact the inner wall 16 of the stator base element 3 with their second faces 15 in a sealing manner wherein the inner wall 16 is arranged opposite to the outer enveloping surface 14.

The rotor 9 is connected torque proof with the camshaft of the internal combustion engine. In order to change the angular position of the camshaft relative to the crankshaft the rotor 9 is rotated relative to the stator 2 about the rotation axis 10, wherein the stator 2 is arranged coaxial to the rotor 9. Thus, depending on the selected direction of rotation the pressure medium in the first pressure chamber 11 or in the second pressure chamber 12 is pressurized while the second pressure chamber 12 or the first pressure chamber 11 is unloaded. The unloading is performed using a tank access which is opened for unloading.

In order for the rotor 9 to be rotated counter clockwise relative to the stator 2 radial first hub bore holes 17 are pressurized by the hydraulic valve wherein the first radial hub bore holes are evenly distributed over the circumference of the rotor hub 8. In order to rotate the rotor 9 clockwise relative to the stator 2 radial second hub bore holes 18 are pressurized by the hydraulic valve wherein the radial second hub bore holes are also distributed over the circumference of the rotor hub 8, wherein the second hub bore holes 18 are positioned axially offset from the first hub bore holes 17.

For locking the stator 2 with the rotor 9 a locking device 36 is provided. The locking device 36 includes a locking bolt 23 in addition to a locking disc 19 arranged coaxial to the rotor 9 and the stator 2. The locking disc 19 is configured so that it contacts a first rotor disc surface 20 of the rotor 9 flat. At a second rotor disc surface 21 of the rotor 9 which is oriented away from the first rotor disc surface 20 a cover is arranged which covers the rotor 9 and the stator 2 and which is not illustrated in more detail. The cover is configured as a plastic cover but it can also be made from metal.

Figure 2:
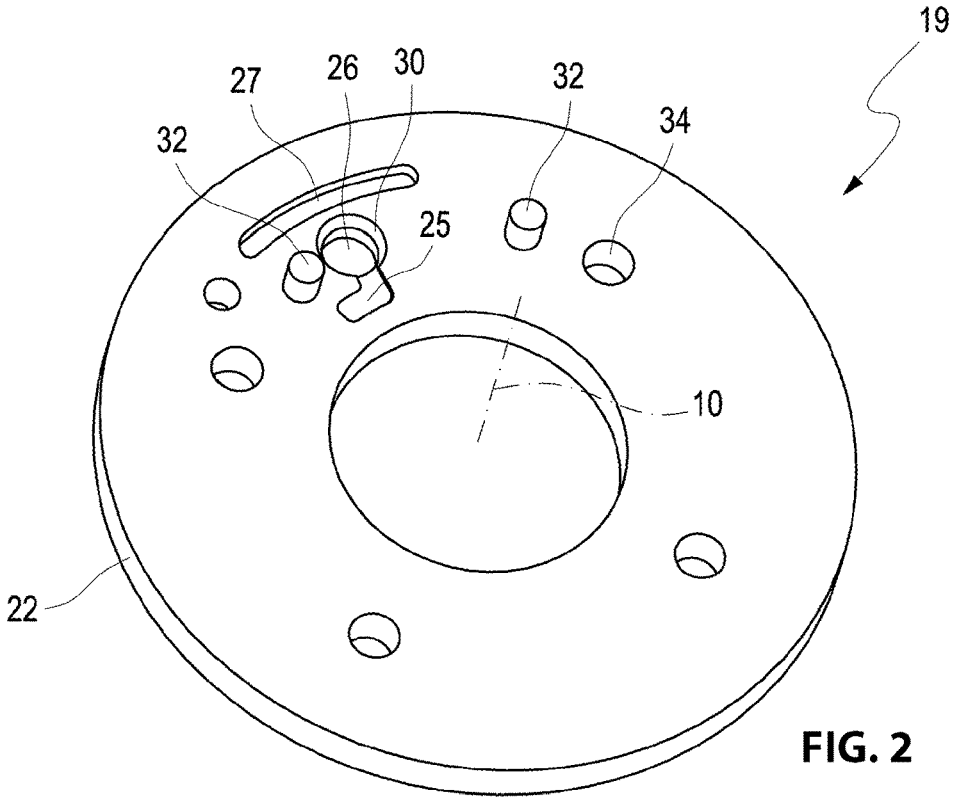
FIG. 2 illustrates a perspective view of a locking disc of a cam phaser according to the invention in a first embodiment.
Figure 3:
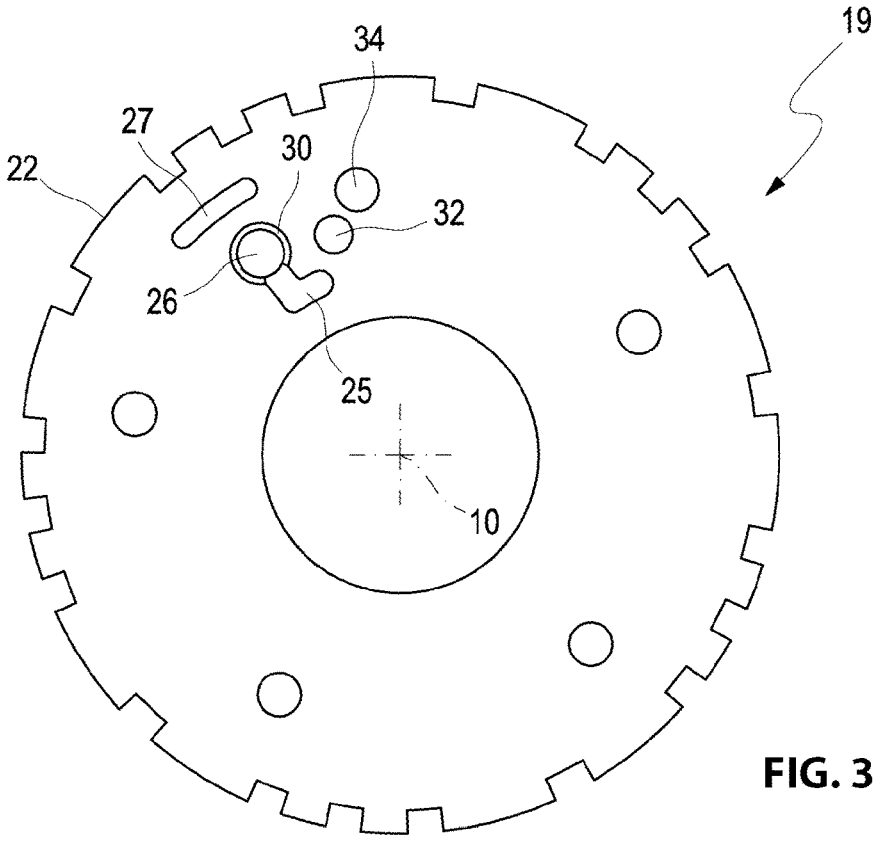
FIG. 3 illustrates a perspective view of the locking disc of the cam phaser in a second embodiment.

When the locking disc 19 is associated with the cam phaser 1 according to FIG. 2 the cover is pressed onto an outer edge 22 of the locking disc 19. The locking disc 19 according to FIG. 3 includes a serrated outer edge 22 wherein the cover is precisely inserted in an axial direction, thus in a direction of the rotation axis 10.

Figure 4:
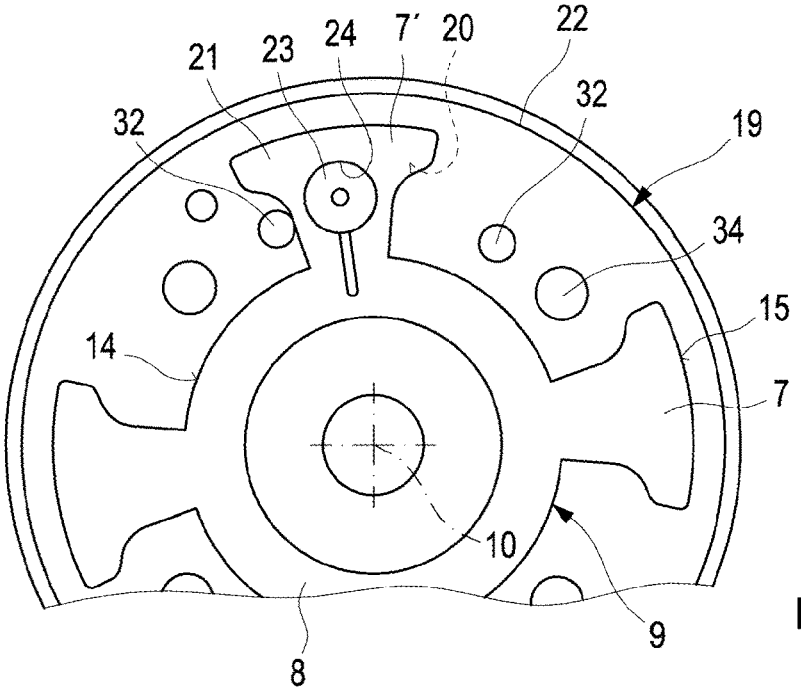
FIG. 4 illustrates a front view of a locking disc with the rotor of the cam phaser according to FIG. 2.
Figure 5:
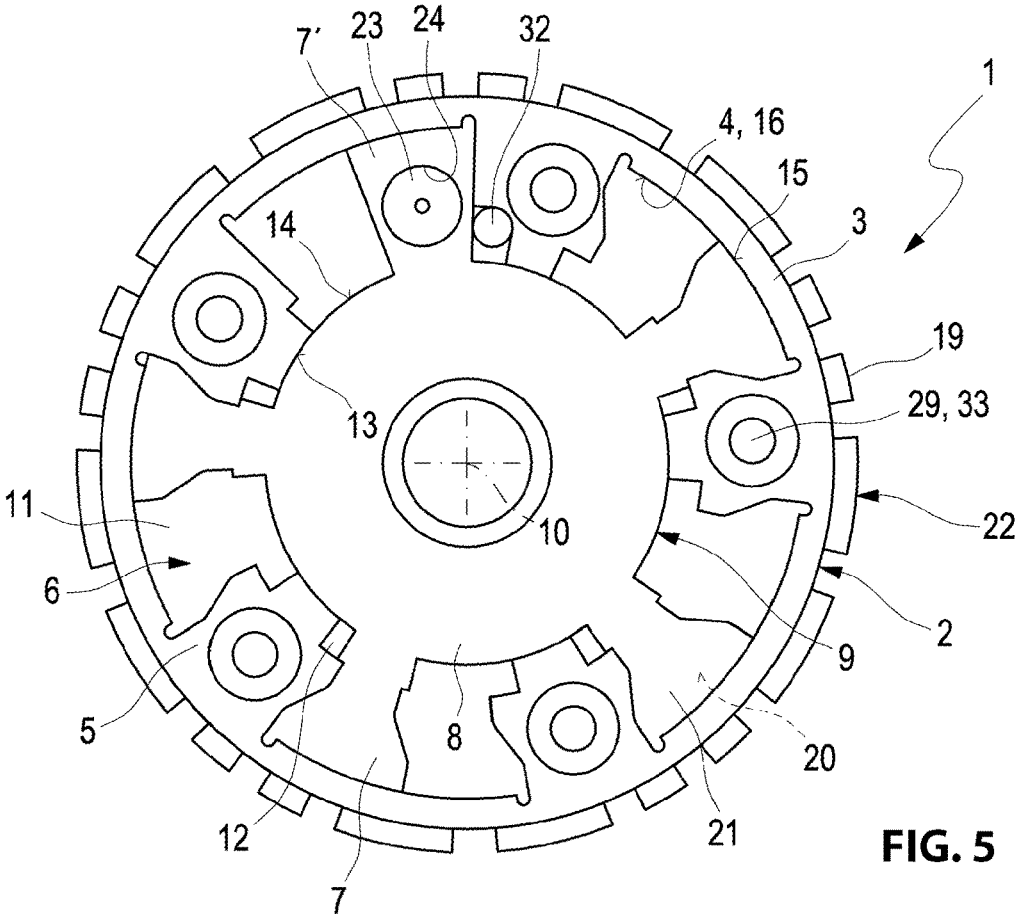
FIG. 5 illustrates a front view of a cam phaser according to FIG. 3.
Figure 6:
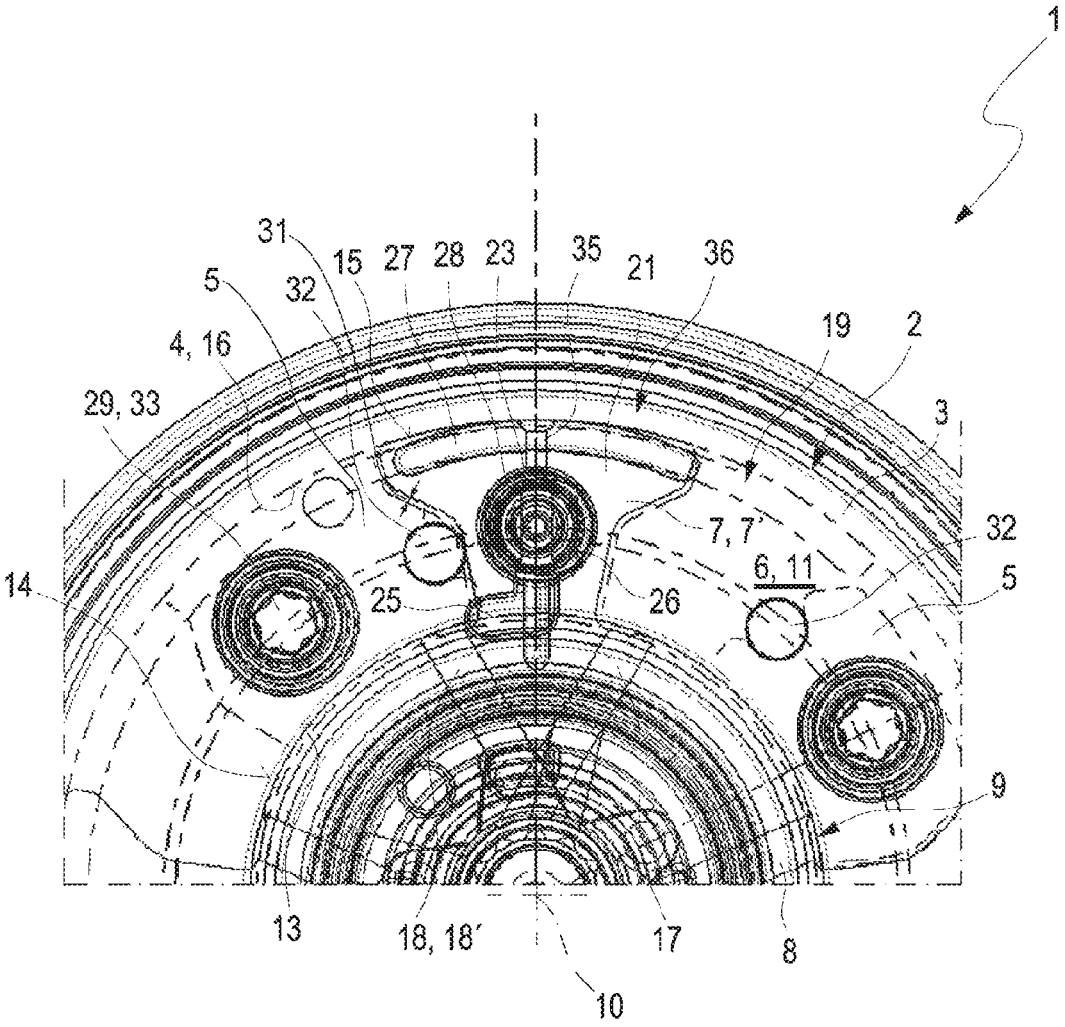
FIG. 6 illustrates a front view of a detail of the cam phaser according to the invention in a third embodiment.

FIG. 4 illustrates the cam phaser 1 according to the invention in a first embodiment including the rotor 9 and the locking disc 19 according to the FIG. 2. FIG. 5 illustrates the cam phaser 1 according to the invention in a second embodiment including the rotor 9, the stator 2 and the locking disc 19 according to FIG. 3.

Irrespective of the outer edge 22 of the locking disc 19 a lobe 7' of the lobes 7 supports the locking bolt 23. This locking bolt 23 is received axially movable along the rotation axis 10 in a receiving bore hole of the lobe 7'. The locking bolt 23 is configured hollow cylindrical and includes a coil spring that is received within the hollow cylinder and which is not illustrated in more detail. The coil spring is supported at a support element 28 which closes the receiving opening 24 at the second rotor disc surface 21 so that an axial movement of the locking bolt 23 in a direction towards the second rotor disc surface 21 is limited.

A second hub bore hole 18' of the second hub bore holes 18 leads to a load channel 25 that is configured in the locking disc 19. This load channel 25 is hydraulically connected with a locking bore hole 26 that is configured in the locking disc 19 wherein the locking bolt 23 can be inserted into the locking bore hole 26 to provide the locking.

Furthermore the locking disc 19 includes an unloading channel 27 which is configured in the locking disc 19 and hydraulically separated from the load channel 25 and the locking bore hole 26.

The load channel 25, the locking bore hole 26 and the unloading channel 27 do not completely penetrate the locking disc. This means that the load channel 25, the locking bore hole 26 and the unloading channel 27 do not completely penetrate the locking disc 19 with their axial extensions, wherein the loading channel 25, the locking bore hole 26 and the unloading channel 27 are open towards the rotor 9 and are configured closed in their axial extensions along the rotation axis 10 in a direction that is oriented away from the rotor 9. The load channel 25 and the unloading channel 27 are introduced as grooves into the locking disc 19 wherein the locking bore hole 26 is bored into the locking disc 19.

The locking bolt 23 includes a pressure loading surface which is not illustrated in more detail and which is configured as a bolt base of the locking bolt 23. This bolt base is arranged so that it is oriented towards the locking bore hole 26. Another annular pressure loading surface which is not illustrated in more detail is configured at an enveloping surface of the locking bolt 23. In a simple embodiment the annular pressure loading surface is configured as a shoulder in the enveloping surface, this means put differently the enveloping surface includes a first diameter over a first axial extension and a second diameter which is smaller than the first diameter over a second axial extension. Due to the different diameters a transition that is configured between a first enveloping surface formed by the first diameter and a second enveloping surface formed by the second diameter is formed as a shoulder. The receiving opening 24 is also configured with shoulders corresponding to the enveloping surface.

Due to the hydraulic connection of the load channel 25 with the locking bore hole 26 the locking bore hole 26 is also loaded when the second bore hole 18' is loaded by the hydraulic fluid and the locking bolt 23 is pressed out of the locking bore hole 26 so that an adjustment of the rotor 9 is facilitated.

Using an additional load channel that is not illustrated in more detail the additional pressure loading surface is loadable with pressure wherein an effective direction of the pressure loading corresponds to an effective direction of the pressure loading of the bolt base. This means both pressure loading surfaces are loadable with pressure against a spring force of the coil spring. In order to provide a pressure balancing during a pressure loading the support element includes at least one balancing opening so that pressure balancing can be provided in a cavity that is formed between the locking bolt 23 and the support element 28. In order for the drive wheel to contact the second rotor disc surface 21 flat in order to avoid a pressure loss and so that the drive wheel contacts bar surfaces of the bars 5 also flat wherein the bar surfaces terminate axially flush with the second rotor disc surface 21, the pressure balancing is provided through a recess in a radially inner portion of the drive wheel wherein the recess is not illustrated in more detail. The drive wheel is fixated at the bars 5 by bolts 29.

The unloading channel 27 that is configured in the locking disc 19 is hydraulically connected with a feed groove 35 configured in the lobe 7'. The unloading channel 27 is arcuate and leads from the bar 5 associated with the locking until shortly in front of a second lateral pressure loading surface of the lobe 7'. Thus, the lobe 7' covers the unloading channel 27 from a direction of the first pressure cavity 11, whereas the unloading channel 27 is pressure loadable from the second pressure cavity 12. Without pressure loading the locking bolt 23 is supported in the locking bore hole 26.

The unloading channel 27 is configured over a relatively large angular range. This assures that the locking bolt 23 is also pressure loaded through the unloading channel 27 from a pressure cavity that is associated with a first end position when the rotor 9 is arranged in a center position between the first end position and a second end position.

The locking bore hole 26 includes a bevel 30 along its circumference at an end that is configured oriented towards the first rotor disc surface 20. The bevel 30 is configured so that a large diameter of bevel 30 that is configured at an end of the locking bore hole 26 and the bevel 30 tapers in an axial direction starting at an end of the locking bore hole 26. A constant diameter corresponding to the smallest diameter of the bevel 30 is configured over a relatively short axial extension of the locking bore hole 26 so that the locking bolt 23 is safely received in the locking bore hole 26 over a sufficient length of the locking bore hole 26.

The locking bore hole 26 thus configured provides that the unlocking is provided very quickly since the locking bolt 23 only has to perform a short stroke to cover the short axial extension of the locking bore hole 26. In order to completely remover the locking bolt 19 from the locking bore hole 26 the bevel 30 provides a supporting force component in the circumferential direction of the locking bolt 19.

For unlocking and locking without binding a particular locking clearance 31 between the stator 2 and the rotor 9 has to be maintained. This means that even in locked condition a rotatability of the rotor 9 relative to the stator 2 is possible in the order of magnitude of the locking clearance 31. In order to exactly maintain the locking clearance 31 which is variable as a function of the requirements for the cam phaser 1 and the size of the cam phaser 1 a contact pin 32 is configured at the locking disc 19. Depending from a first material from which the stator 2 is made the contact pin 32 is made from a second material which is harder and/or more impact resistant than the first material. In an embodiment that is not illustrated in more detail the contact pin 32 is made from the second material, wherein the second material is harder and/or more impact resistant than a third material from which the locking disc 19 is made.

The locking clearance 31 varies depending on the requirements for the cam phaser 1, this means how large the relative rotatability of the camshaft with respect to the crankshaft is that has to be adjusted and depending on the size of the cam phaser 1. Using the contact pin 32 this locking clearance is exactly adjustable when mounting the cam phaser 1. The contact pin 32 represents an end stop of the rotor 9 or of the rotor lobe 7'.

The contact pin 32 is fixated in the portion of the receiving bore hole 24 at the locking disc 19. The exact position of the contact pin 32 is a function of a lobe shape of the lobe 7' since the rotor 9 is rotated on the locking disc 19 during assembly until the lobe 7' contacts the contact pin 32. Then the locking bolt 23 is inserted into the locking bore hole 26 so that the rotor 9 has a fixated end position relative to the locking disc 19. The stator 2 is eventually pushed onto the rotor 9 and rotated relative to the rotor 9 until a position of the stator 2 is established that is desired in the end position of the rotor 9. Typically, the position of the stator 2 that is to be adjusted for the end position of the rotor 9 is defined by a contact of the bar 5 at the lobe 7'. In order to fixate the stator 2 relative to the rotor 9 the stator 2 is fixated by connecting elements 33, typically bolts, at the locking disc 19. Thus, the locking disc 19 includes a respective number of openings 34 in which the connecting elements 33 have to be positioned. In order to provide simplified assembly the connecting elements 33 correspond to the bolts 29 by which the drive wheel is connected torque proof with the stator 2 or its bars 5.

In order to provide a secured attachment the locking disc 19 includes a receiving element configured as a hole into which the contact element 32 is inserted so that it is received in a form locking manner at the locking disc 19. In an embodiment that is not illustrated in more detail the contact element 32 is additionally secured by a weld at the locking disc 19. By the same token the contact element 32 could be exclusively received by a bonded connection at the locking disc. As long as the locking disc 19 is made from a plastic material there is the option to fabricate the contact element 32 in one process step integrally in one piece together with the locking disc 19.

In the embodiment of the cam phaser 1 according to the invention which includes the stop disc 19 according to FIG. 2, two contact pins 32, the contact pin 32 and an additional contact pin 32 are configured on the locking disc 19. This means that the contact pin 32 that is positioned proximal to the interlocking bore hole 26 defines the end position for a counter clockwise rotation of the rotor 9, whereas the contact pin 32 that is positioned remote from the locking bore hole 26 limits a clockwise rotation of the rotor 9. Thus, it is facilitated to adjust two different locking clearances 31, this means that the locking clearance 31 that is adjusted for a counter clockwise rotation of the rotor 9 has a different value than the locking clearance 31 which has to be maintained for a clockwise rotation of the rotor 9.

In order for the cam phaser 1 not to bind during locking and unlocking a precise locking clearance 31 has to be maintained. This locking clearance 31 is a function of manufacturing tolerances of position relevant components of the cam phaser 1. This means that the tolerance concatenation in any case includes all diameter, length and angle tolerances and geometric tolerances like position tolerances of components that are relevant for positioning or which impact the locking clearance 31. Since as described supra the stator 2 is not relevant for positioning the rotor 9 relative to the locking disc 19 and thus not relevant for adjusting the locking clearance 31 all stator related tolerances are irrelevant for the positioning of the rotor 9 relative to the locking disc 19.

REFERENCE NUMERALS AND DESIGNATIONS

1 cam phaser
2 stator
3 stator base element
4 inside
5 bar
6 intermediary space
7, 7' lobe
8 rotor hub
9 rotor
10 rotation axis
11 first pressure cavity
12 second pressure cavity
13 first face
14 outer enveloping surface
15 second face
16 inner wall
17 first hub bore hole
18, 18' second hub bore hole
19 locking disc
20 first rotor disc surface
21 second rotor disc surface
22 outer edge
23 locking bolt
24 receiving opening
25 loading channel

26 locking bore hole
27 unloading channel
28 support element
29 bolt
30 bevel
31 locking clearance
32 contact pin
33 connecting element
34 opening
35 feed groove
36 locking device

What is claimed is:

1. A cam phaser, comprising:

a rotor; and a stator, wherein the rotor is rotatable relative to the stator, wherein a lobe of the rotor is arrangeable between two bars of the stator, wherein the lobe divides an intermediary space formed between the two bars into a first pressure cavity and a second pressure cavity, wherein a locking device including a spring loaded locking bolt and a locking disc is configured to lock the stator relative to the rotor in an end position, wherein a locking provides a locking clearance for moving the rotor relative to the stator, and wherein the locking disc includes a contact element for adjusting the end position.

2. The cam phaser according to claim 1, wherein the spring loaded locking bolt is receivable in its entirety in a receiving opening of the lobe.

3. The cam phaser according to claim 1, wherein the locking disc includes a locking bore hole for at least partially receiving the spring loaded locking bolt.

4. The cam phaser according to claim 1, wherein the locking disc is positioned so that it contacts the rotor and the stator axially flat and so that the locking disc is coaxial with the rotor and the stator.

5. The cam phaser according to claim 1, wherein the contact element is configured as a pin.

6. The cam phaser according to claim 1, wherein the contact element is arranged in a portion of the locking bore hole.

7. The cam phaser according to claim 1, wherein the contact element is made from a first material which is harder, or more impact resistant than a second material from which the stator is made, or harder, or more impact resistant than a third material from which the locking disc is made.

8. The cam phaser according to claim 1, wherein the contact element is received in a form locking manner at the locking disc.

9. The cam phaser according to claim 1, wherein the contact element is attached at the locking disc by a bonded connection.

10. The cam phaser according to claim 1, wherein the locking disc includes a second contact pin for adjusting two different locking clearances.

11. The cam phaser according to claim 1, wherein a connecting element for connecting the stator with the locking disc is a bolt which connects a drive wheel of a camshaft with the stator in a torque proof manner.

12. The cam phaser according to claim 1, wherein the contact element is made from a first material which is harder and more impact resistant than a second material from which the stator is made, and harder and more impact resistant than a third material from which the locking disc is made.

* * * * *